United States Patent [19]

Shen

[11] Patent Number: 4,930,822

[45] Date of Patent: Jun. 5, 1990

[54] RETENTION PLATE ASSEMBLY FOR RETAINING A LOCK

[76] Inventor: Chao C. Shen, No. 233, Sec. 2, Hai Tien Rd., Tainan City, Taiwan

[21] Appl. No.: 329,684

[22] Filed: Mar. 28, 1989

[51] Int. Cl.[5] ..... E05B 15/02

[52] U.S. Cl. ..... 292/357; 292/DIG. 53; 70/370

[58] Field of Search ..... 292/357, 347, 169, DIG. 53; 70/367, 370, 371

[56] References Cited

U.S. PATENT DOCUMENTS

| | | | |
|---|---|---|---|
| 1,480,650 | 1/1924 | Bacon | 70/370 |
| 2,283,674 | 5/1942 | Geyer | 292/357 |
| 2,312,643 | 3/1943 | Hoettels | 70/370 |
| 2,689,700 | 9/1954 | Drury | 70/370 |
| 2,828,153 | 3/1958 | Ahlquist | 292/357 |
| 3,241,874 | 3/1966 | Russell et al. | 292/337 |
| 3,269,762 | 8/1966 | Lint | 292/357 |
| 3,503,233 | 3/1970 | Russell et al. | 70/370 |
| 3,718,015 | 2/1973 | Tornoe et al. | 292/347 X |
| 3,955,387 | 5/1976 | Best et al. | 292/347 X |
| 3,985,008 | 10/1976 | Hart | 292/357 X |
| 4,052,868 | 10/1977 | Best et al. | 292/347 X |
| 4,381,656 | 5/1983 | Hayakawa | 70/370 X |
| 4,586,354 | 5/1986 | Smith | 70/370 X |

*Primary Examiner*—Gary L. Smith
*Assistant Examiner*—Michael J. Milano
*Attorney, Agent, or Firm*—Bacon & Thomas

[57] ABSTRACT

A retention plate assembly for fixedly retaining a lock in a door. The lock is adapted to be mountable onto the retention plate assembly. The door for mounting the retention plate assembly has a bore defining an edge from which extends a pair of slots opposite to each other. A pair of holes are disposed adjacent to the bore. The retention plate assembly comprises a retention plate and a pair of bolts. The retention plate has a pair of tangential tabs, a pair of radial tabs and a pair of threaded through-holes. When the retention plate assembly is mounted onto the bore of the door, the tangential tabs bear against the edge of said bore and the radial tabs fit snugly within the slots of the door. The pair of bolts each have a threaded end of reduced diameter with respect to the diameter of the bolt. The bolt also has another end manipulatable for releasably engaging its threaded end to the threaded through-hole of the retention plate.

3 Claims, 4 Drawing Sheets

RETENTION PLATE ASSEMBLY FOR RETAINING A LOCK

BACKGROUND OF THE INVENTION

This invention relates to a retention mechanism to cooperate with installation of a lock of a particular kind. The lock involved is one which customarily is inserted through opposite faces of the door, requiring a relatively large cutout to accommodate the lock casing or housing.

There is a certain line of locks of a relatively rugged type, with high durability, which requires a retention mechansim for installation in a slightly different manner from the technique and structure employed in ordinary residential locks. The lock under consideration generally consists of a substantially cylindrical housing. For ease of operation and reliable durability, these locks often have heavy and long handles or heavy elements therein such that strong lock support is required.

SUMMARY OF THE INVENTION

A primary object of the present invention is to provide a retention mechanism or a retention plate in cooperation with a lock, or a housing or casing of a lock, to firmly retain the lock in position.

This and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

In an embodiment of the invention chosen for purposes of illustration, there is shown a door 10 having an edge 11 and opposite faces 12 and 13. A bore 14 is formed by boring through the door 10 from one or another of the faces 12 or 13 through the opposite face.

Figure 1:
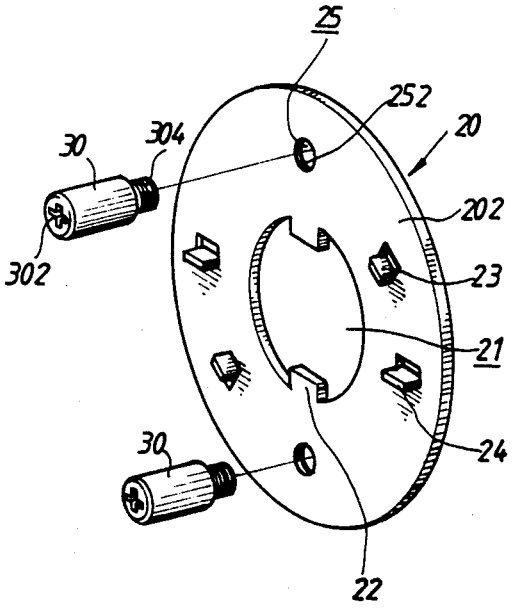
FIG. 1 is an exploded view of a retention plate assembly in accordance with the present invention.
Figure 2:
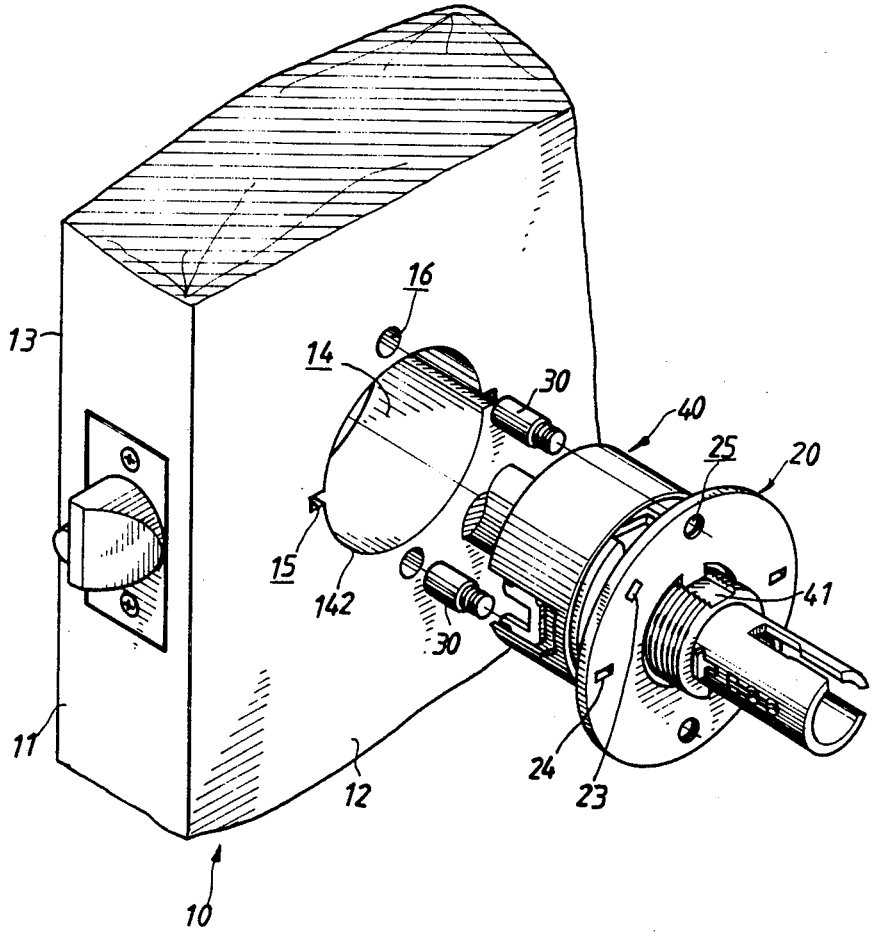
FIG. 2 shows the retention plate of FIG. 1 mounted on the housing of a lock and a wooden door for mounting.

As shown in FIG. 1, a retention plate assembly of the present invention comprises a retention plate 20 and a pair of bolts 30. The retention plate 20 is substantially circular with a central cutout 21. A pair of protuberances 22, preferably opposite to each other, are formed at the periphery of cutout 21. The protuberances 22 are engageable within recesses 41 suitably formed on a lock 40, as shown in FIG. 2. With the recesses 41 thus formed on the lock 40, the lock 40 will be maintained stationary relative to the retention plate 20 and become firmly supported thereon when two retention plate assemblies are mounted on the door 10 from both faces 12 and 13 thereof.

Referring again to FIG. 1, the retention plate 20 further has a pair of tangential tabs 23, a pair of radial tabs 24 and a pair of through-holes 25 with threads 252 thereon. Each pair of tabs 23 or 24 or through-holes 25 are preferably disposed opposite to each other to create equivalences between the retention plate 20, with the lock 40 supported thereon, and the door 10. The tangential tabs 23 and radial tabs 24 are formed from the metal of the retention plate 20 by punching them out and bending them in an inward direction with respect to an inner face 202 of the retention plate 20. The pair of bolts 30 each have a threaded end 304 of reduced diameter with respect to the diameter of the bolt 30. Another end of the bolt 30 has a crossed slot 302 adapted to be urged by a screw driver or the like, such that the bolts 30 are each engageable with a respective through-hole 25. As is apparent, the threads 252 on the through-hole 25 are utilized to threadedly receive the threaded end 304 of the bolt 30.

Figure 3:
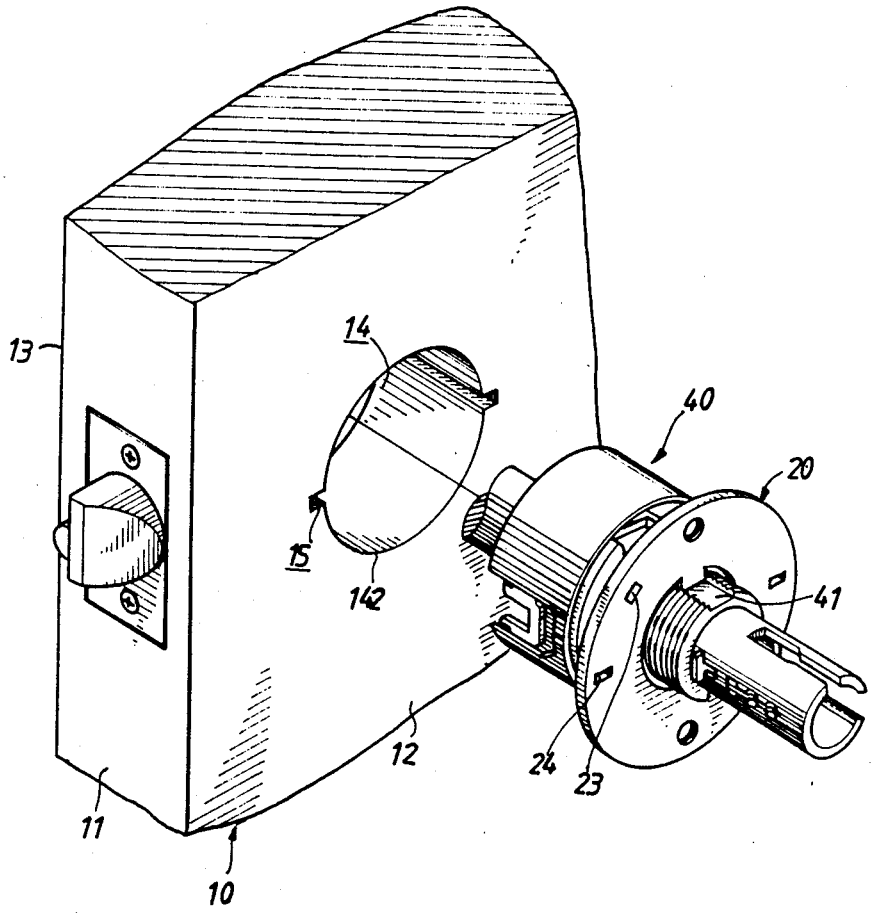
FIG. 3 is a view similar to FIG. 2, but with a metallic door for mounting and with the bolts removed.

FIGS. 2 and 3 show the retention plate 20 mounted onto the recesses 41 of the lock 40 to be assembled to the wooden door and metallic door, respectively. For convenience, the metallic door in FIG. 3 bears the same numerals as the wooden door in FIG. 2. The difference between the wooden door and the metallic door with respect to the retention plate assembly of the present invention is that the pair of bolts 30 are unscrewed or removed from the retention plate assembly and the metallic door does not have a pair of holes 16 corresponding to the bolts 30. The above situation is needed when it is not desirable to have holes on the metallic door or when it is difficult, if not impossible, to have holes thereon.

Referring particularly to FIG. 2, the bore 14 defines an edge 142 which bears against the pair of tangential tabs 23. A pair of horizontal slots 15 are positioned opposite to each other along the edge 142 for receiving the pair of radial tabs 24. A pair of holes 16 of adequate depth are provided adjacent to the bore 14. As can be understood, the pair of holes 16 are adapted to receive the pair of bolts 30.

Figure 4:
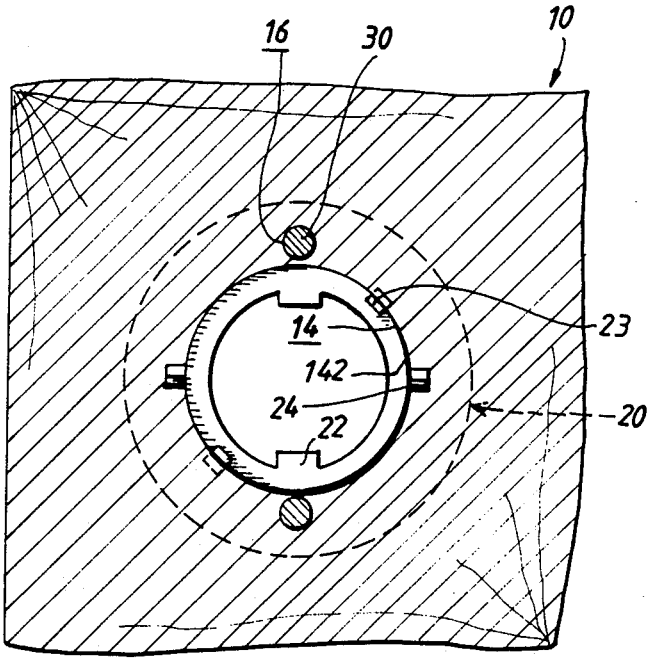
FIG. 4 is a cross-sectional view showing the retention plate assembly of FIG. 1 mounted on a wooden door.

FIG. 4 shows a cross-sectional view of the retention plate assembly mounted on the wooden door. As described hereinabove, each tangential tab 23 is preferably disposed substantially between a corresponding radial tab 24 and a corresponding through-hole 25 and bears against the edge 142. The pair of tangential tabs 23 prevent sideward movement of the retention plate 20 and, therefore, the lock 40 (not shown in FIG. 4) attached thereto. The pair of radial tabs 24 fit snugly within the horizontal slots 15 so that rotation of the retention plate about its axis is prevented. Further, the pair of bolts 30 fixedly screwed on the retention plate 20 to keep the retention plate 20 in position. It will appear, therefore, from the foregoing desciption that the retention plate assembly is an extremely simple mechanism for securely anchoring the lock 40 in its position.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A retention plate assembly for retaining a lock in a wooden door or a metallic door having at least a cylindrical bore therethrough for receiving the lock, and including a planar retention plate having a central cutout provided with a pair of opposed inwardly extending protuberances for engagement within corresponding recesses formed on the lock, the assembly comprising:

(a) a pair of radial tabs on the retention plate positioned on opposite sides of the cutout and disposable in a substantially horizontal plane perpendicuar to the plane of the retention plate when the radial tabs are engaged within a pair of corresponding slots formed on opposite sides of a door bore to prevent rotational movement of the retention plate;

(b) a pair of tangential tabs on the retention plate, the tangential tabs being positioned diametrically opposite each other across the cutout for engaging exterior edge portions of the door bore to prevent translational movement of the retention plate; and (c) a pair of threaded holes extending through the retention plate and disposed on opposite sides of the cutout, and a pair of bolts, each bolt including a first threaded portion engageable within a threaded hole and a second portion for engagement within a corresponding hole provided in the door.

2. The retention plate assembly of claim 1 wherein the first threaded portion of each bolt is of a reduced diameter and the second portion of each bolt includes means engageable by a tool for securing the bolt to the retention plate.

3. The retention plate assembly of claim 1 wherein each tangential tab is positioned between a corresponding radial tab and a corresponding threaded hole.

* * * * *